US011506452B2

(12) United States Patent
Kang et al.

(10) Patent No.: US 11,506,452 B2
(45) Date of Patent: Nov. 22, 2022

(54) REFRIGERATOR

(71) Applicant: Samsung Electronics Co., Ltd., Suwon-si (KR)

(72) Inventors: Hyo Suck Kang, Suwon-si (KR); Jong Kyoung Bok, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 40 days.

(21) Appl. No.: 17/309,503

(22) PCT Filed: Nov. 27, 2019

(86) PCT No.: PCT/KR2019/016408

§ 371 (c)(1),
(2) Date: Jun. 2, 2021

(87) PCT Pub. No.: WO2020/122468

PCT Pub. Date: Jun. 18, 2020

(65) Prior Publication Data

US 2022/0034583 A1 Feb. 3, 2022

(30) Foreign Application Priority Data

Dec. 11, 2018 (KR) ..... 10-2018-0159536

(51) Int. Cl.

| | |
|---|---|
| ***F25D 31/00*** | (2006.01) |
| ***F25D 23/06*** | (2006.01) |
| ***F25D 25/02*** | (2006.01) |

(52) U.S. Cl.

CPC ..... *F25D 31/007* (2013.01); *F25D 23/067* (2013.01); *F25D 25/02* (2013.01); *F25D 2331/803* (2013.01)

(58) Field of Classification Search

CPC .... F25D 25/024; F25D 31/007; F25D 23/067; F25D 25/02; F25D 2325/023;

(Continued)

(56) References Cited

U.S. PATENT DOCUMENTS 2,276,942 A * 3/1942 Dibble ..... F25D 25/024 108/143
2,553,960 A * 5/1951 De Swart ..... A47B 57/425 248/250

(Continued)

FOREIGN PATENT DOCUMENTS

EP 0582784 A1 * 2/1994 ..... F25D 25/02
KR 20-1997-0024923 U 6/1997

(Continued)

OTHER PUBLICATIONS

International Search Report and Written Opinion of the International Searching Authority in connection with International Application No. PCT/KR2019/016408 dated Mar. 26, 2020, 9 pages.

*Primary Examiner* — Hiwot E Tefera

(57) ABSTRACT

The present disclosure relates to a refrigerator including a main body in a storage compartment is provided, a rack to partition an inner space of the storage compartment in an up-down direction, a pair of support protrusions protruding from opposite inner sidewalls of the storage compartment to support the rack, and buffer members disposed on the support protrusions to elastically support opposite side ends of the rack.

10 Claims, 8 Drawing Sheets

(58) Field of Classification Search
CPC ..... F25D 2331/803; F25D 2331/809; F25D 23/06; F25D 23/066; F25D 23/04; F25D 25/021; A47B 55/02; A47B 73/002; A47B 96/021; A47B 96/06; A47F 7/28
See application file for complete search history.

(56) References Cited

U.S. PATENT DOCUMENTS 3,506,325 A * 4/1970 Horvay ..... F25D 25/02 312/223.5
3,637,085 A * 1/1972 Ball ..... A47B 96/021 211/153
3,666,228 A * 5/1972 Arnold ..... A47B 57/30 248/250
4,534,530 A * 8/1985 Danko ..... F16B 21/088 248/239
5,004,305 A * 4/1991 Montuoro ..... F25D 23/04 312/405.1
6,663,204 B2 12/2003 Atalla et al.
9,644,885 B1 * 5/2017 Johnson ..... F25D 25/02
2005/0258118 A1 * 11/2005 Lee ..... A47B 73/002 211/134
2017/0276423 A1 * 9/2017 Jung ..... F25D 23/02
2017/0328627 A1 * 11/2017 Park ..... F25D 23/04
2021/0180854 A1 * 6/2021 Hwang ..... A47B 88/417

FOREIGN PATENT DOCUMENTS

KR 10-2005-0119852 A 12/2005
KR 10-0565247 B1 3/2006
KR 10-0575679 B1 5/2006
KR 10-1484083 B1 1/2015
WO WO-2007031451 A1 * 3/2007 ..... F25D 23/066
WO WO-2010127946 A2 * 11/2010 ..... F25D 25/02

* cited by examiner

REFRIGERATOR

CROSS-REFERENCE TO RELATED APPLICATIONS

This application is a 371 of International Application No. PCT/KR2019/016408, filed Nov. 27, 2019, which claims priority to Korean Patent Application No. 10-2018-0159536, filed Dec. 11, 2018, the disclosures of which are herein incorporated by reference in their entirety.

BACKGROUND

1. Field

The present disclosure relates to a refrigerator, and more particularly, to a refrigerator including a rack on which wine bottles are placed.

2. Description of Related Art

A refrigerator is an appliance that stores food, etc. stored in a storage compartment at a low temperature by supplying cold air generated through a refrigerating cycle to the storage compartment. Recently, among refrigerators, there is a refrigerator including a rack on which wine bottles are placed so that the wine bottles may be stored on the rack.

A main body of the refrigerator includes support protrusions protruding from opposite inner sidewalls of the storage compartment, and the rack is disposed inside the storage compartment in a state in which opposite side ends thereof are supported on the support protrusions.

The refrigerator includes a compressor for compressing a refrigerant, a fan for circulating air, and the like in order to generate cold air, and thus vibration inevitably occurs during the operation of the compressor or the fan, and the vibration may be transmitted to the rack through the support protrusions to generate noise.

SUMMARY

The present disclosure is directed to providing a refrigerator capable of reducing vibration transmitted to a rack.

An aspect of the present disclosure provides a refrigerator including a main body in a storage compartment is provided, a rack disposed inside the storage compartment, a pair of support protrusions protruding from opposite inner sidewalls of the storage compartment to support the rack, and buffer members disposed on the support protrusions to elastically support opposite side ends of the rack.

The rack may include a pair of rack frames extending in a front-rear direction to be placed on the pair of support protrusions, and a plurality of supports extending in a left-right direction to be fixed to the pair of rack frames and spaced apart from each other in the front-rear direction.

The buffer member may include a first seating groove extending in the front-rear direction so that the rack frame is seated thereon.

The buffer members may include a straight buffer member including only the first seating groove.

The buffer member may include a second seating groove in which the support is seated.

The buffer members may include an L-shaped buffer member in which the first seating groove and the second seating groove are connected to form an L shape.

The L-shaped buffer member may further include a rear portion protruding upward from a rear side of an upper surface thereof to face a rear end of the rack frame.

The buffer members may include a T-shaped buffer member in which the first seating groove and the second seating groove are connected to form a T shape.

The buffer member may include a locking part protruding from a lower surface thereof to be inserted into the support protrusion, and the support protrusion may include a locking groove into which the locking part is inserted and locked.

The locking part and the locking groove may have a trapezoidal cross section and extend in the left-right direction.

The buffer members may include a side portion protruding upward from one side of an upper surface thereof to face a side surface of the rack frame, and the main body may include accommodating grooves provided on the opposite inner sidewalls of the storage compartment to accommodate the side portions.

The side portion may have a larger width than a depth of the accommodating groove.

Another aspect of the present disclosure provides a refrigerator including a main body in a storage compartment is provided, a rack disposed inside the storage compartment, a pair of support protrusions protruding from opposite inner sidewalls of the storage compartment to support the rack, and buffer members formed of an elastic material and disposed on the support protrusions to separate opposite side ends of the rack from the support protrusions and the opposite inner sidewalls of the storage compartment.

According to a refrigerator of the present disclosure, buffer members are disposed between support protrusions of a main body and opposite side ends of a rack, so that vibration transmitted to the rack can be greatly reduced.

DETAILED DESCRIPTION

Figure 1:
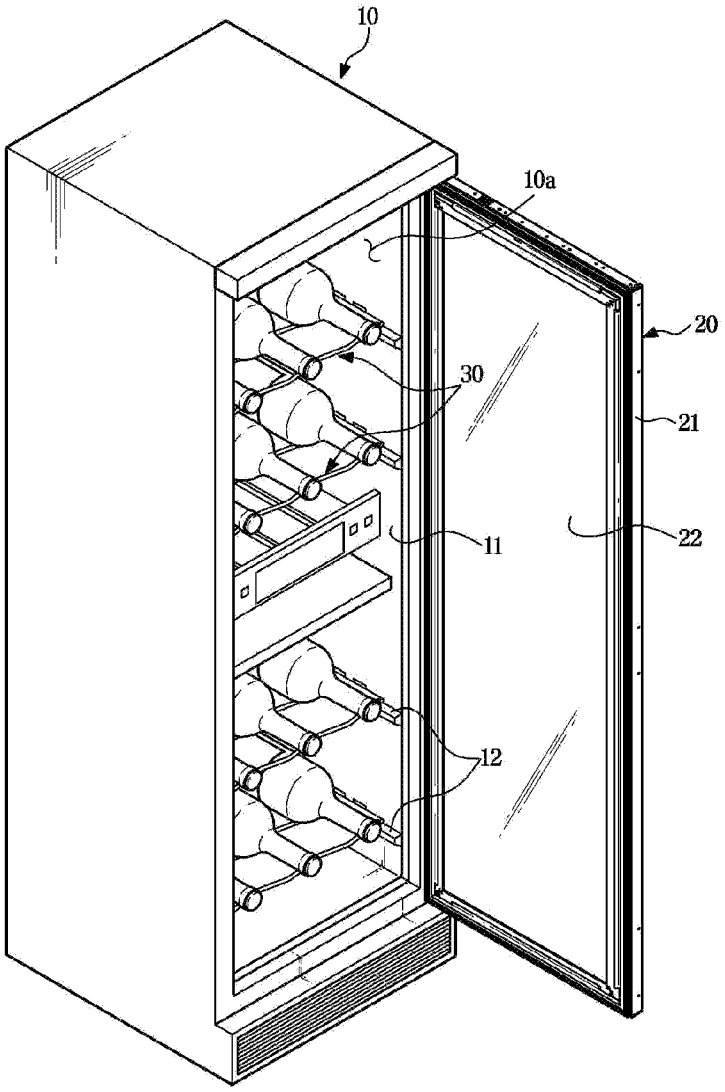
FIG. 1 is a perspective view of a refrigerator according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms, and these terms are only used to distinguish one component from another. For example, without departing from the scope of the present disclosure, the first component may be referred to as a second component, and similarly, the second component may also be referred to as a first component.

Hereinafter, embodiments of the present disclosure will be described in detail with reference to the accompanying drawings. In this specification, the terms "front end," "rear end," "upper portion," "lower portion," "upper end" and "lower end" used in the following description are defined with reference to the drawings, and the shape and position of each component are not limited by these terms.

FIG. 1 is a perspective view of a refrigerator according to an embodiment of the present disclosure.

A refrigerator as illustrated in FIG. 1 is a wine refrigerator used for storing wine bottles.

The refrigerator includes a main body 10 provided with a storage compartment 10*a* and a door 20 to open and close the storage compartment 10*a*.

The main body 10 is formed in a rectangular parallelepiped shape with an open front to form the storage chamber 10*a*, and a plurality of racks 30 is disposed inside the storage compartment 10*a* to partition an inner space of the storage compartment 10*a* in an up-down direction. Support protrusions 12 to support opposite side ends of the racks 30 are formed on opposite inner sidewalls of the main body 10 forming the storage compartment 10*a*.

The door 20 is rotatably installed on one side of a front side of the main body 10 to open and close the storage compartment 10*a* by rotation. The door 20 includes a door frame 21 formed in a rectangular ring shape, and a transparent window 22 formed of a transparent material and installed inside the door frame 21. Accordingly, the user may check the inside of the storage compartment 10*a* from the outside of the door 20 through the transparent window 22.

Figure 2:
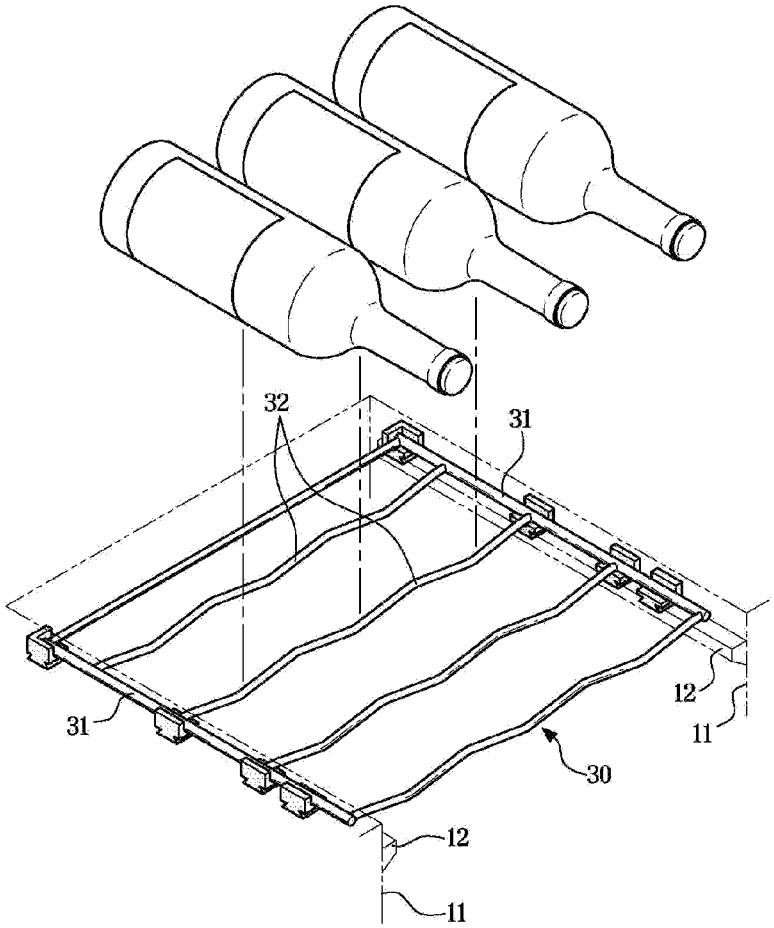
FIG. 2 is a perspective view of a rack provided in the refrigerator according to an embodiment of the present disclosure.
Figure 3:
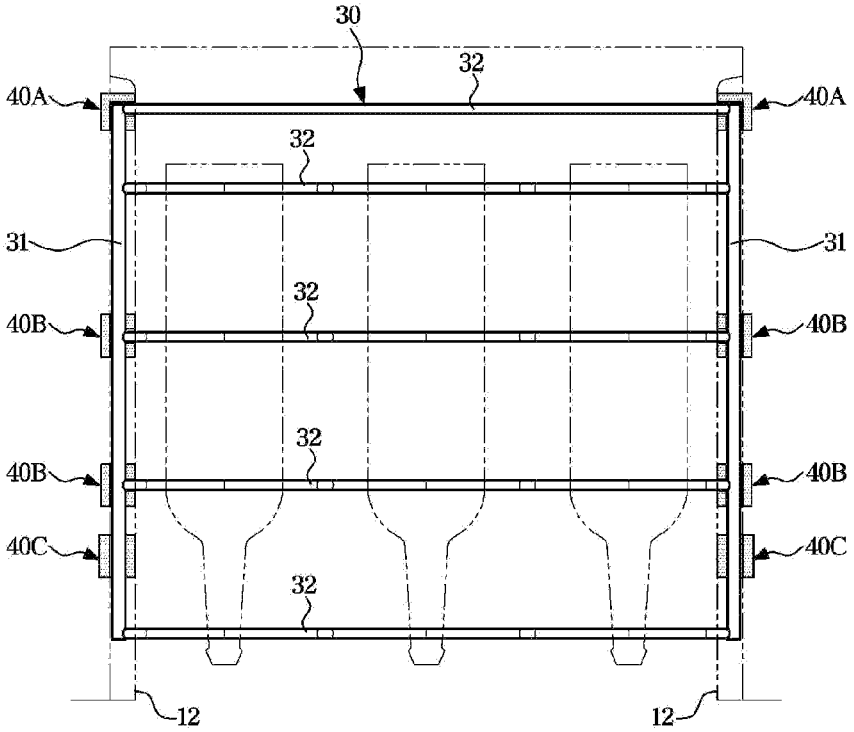
FIG. 3 is a plan view of the rack provided in the refrigerator according to an embodiment of the present disclosure.

As illustrated in FIGS. 2 and 3, the rack 30 is formed of a wire rack formed by wires. Therefore, even in a state in which wine bottles are placed on the rack 30, air may flow through the rack 30 in the up-down direction.

The rack 30 includes a pair of rack frames 31 extending long in a front-rear direction and spaced apart in a left-right direction, and a plurality of supports 32 extending in the left-right direction to be fixed to two of the rack frames 31 at opposite side ends thereof and spaced apart from each other in the front-rear direction.

The rack frames 31 are supported by being placed on the support protrusions 12. That is, two of the rack frames 31 form the opposite side ends of the rack 30 described above.

The remaining supports 32 except for the support 32 located at the rearmost among the supports 32 include a seating part (not provided with a reference numeral) formed by bending a predetermined portion thereof downward. The seating part is provided to suppress the left and right movement of the wine bottles placed thereon, the supports 32 according to the present embodiment are provided to accommodate three wine bottles, and for this purpose, each of the supports 32 includes three of the seating parts.

The support 32 located at the rearmost among the supports 32 extends in a straight shape to support a lower portion of a rear end of the wine bottles placed on the remaining supports 32. Therefore, the rear end of the wine bottle is prevented from being in contact with a rear surface inside the storage compartment 10*a* by the support 32 located at the rearmost side.

In the present embodiment, the rack frames 31 and the supports 32 are each formed of a metal material, and the rack frames 31 are formed to have a larger diameter than the supports 32. This is to take into account that a relatively large load acts on the rack frames 31.

Figure 4:
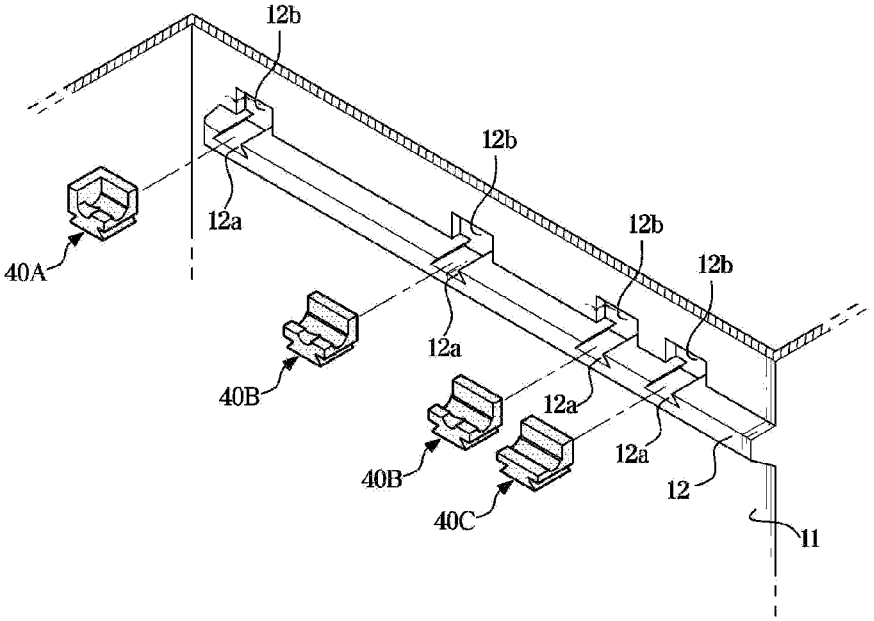
FIG. 4 is an exploded perspective view of buffer members provided in the refrigerator according to an embodiment of the present disclosure.
Figure 5:
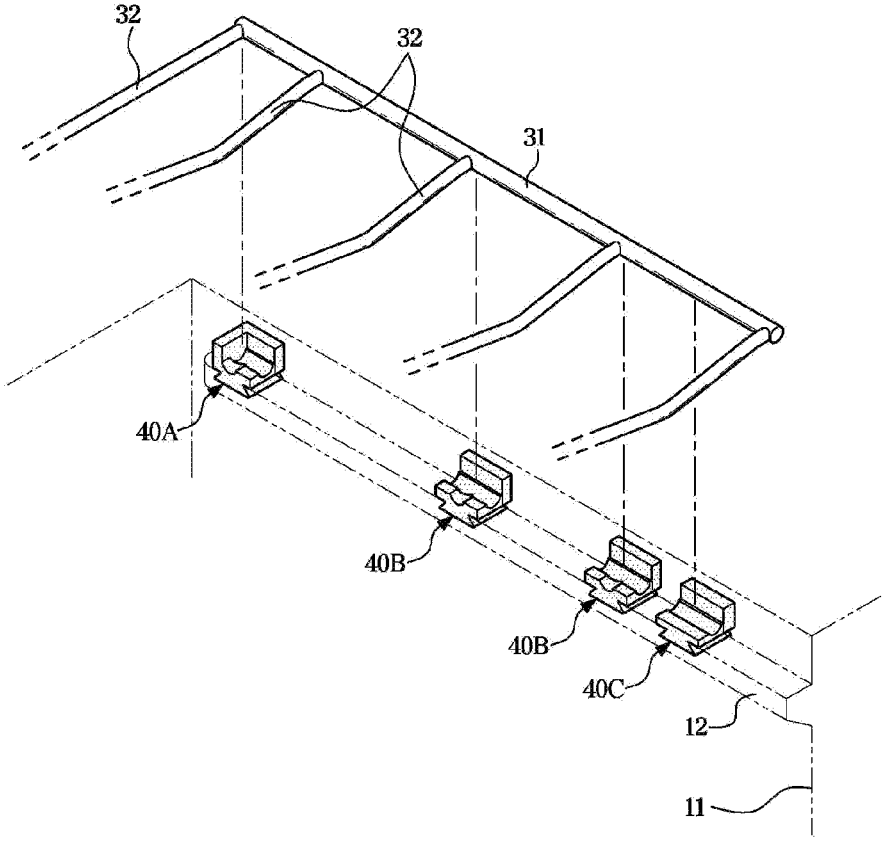
FIG. 5 is an exploded perspective view illustrating that the rack is installed through the buffer members in the refrigerator according to an embodiment of the present disclosure.

As illustrated in FIGS. 4 and 5, buffer members 40A, 40B, and 40C made of an elastic material are disposed between the opposite side ends of the rack 30, that is, between opposite ends of the rack frame 31 and the support protrusions 12.

The buffer members 40A, 40B, 40C may be formed of various elastic materials capable of absorbing vibration, such as rubber, and are installed on the support protrusion 12 to elastically support the opposite ends of the rack frame 31. The buffer members 40A, 40B, and 40C are formed to have a predetermined thickness so that lower surfaces of the rack frames 31 and the supports 32 are maintained in a state of being spaced apart from the support protrusion 12.

Figure 6:
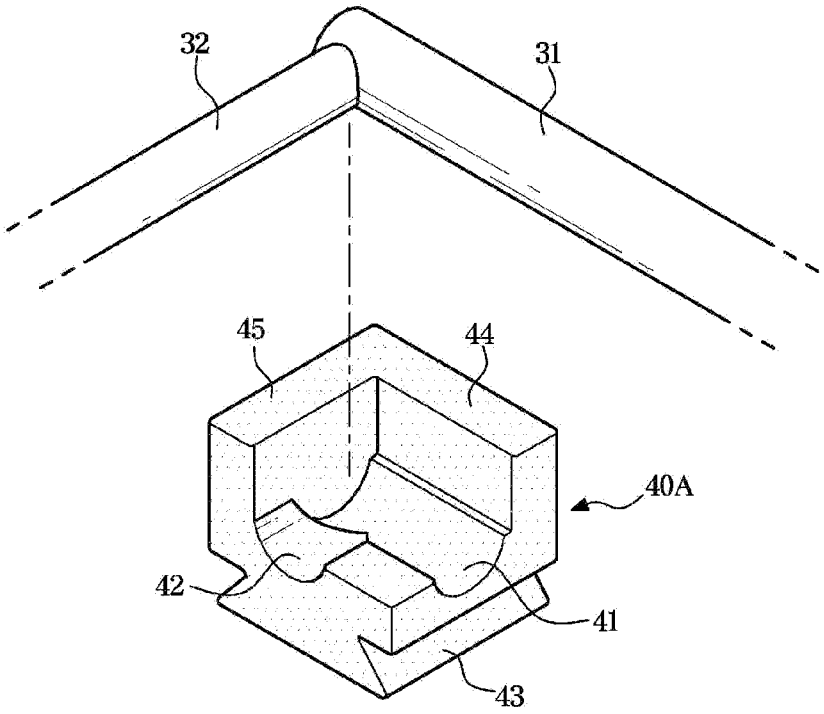
FIG. 6 is a perspective view of an L-shaped buffer member provided in the refrigerator according to an embodiment of the present disclosure.
Figure 7:
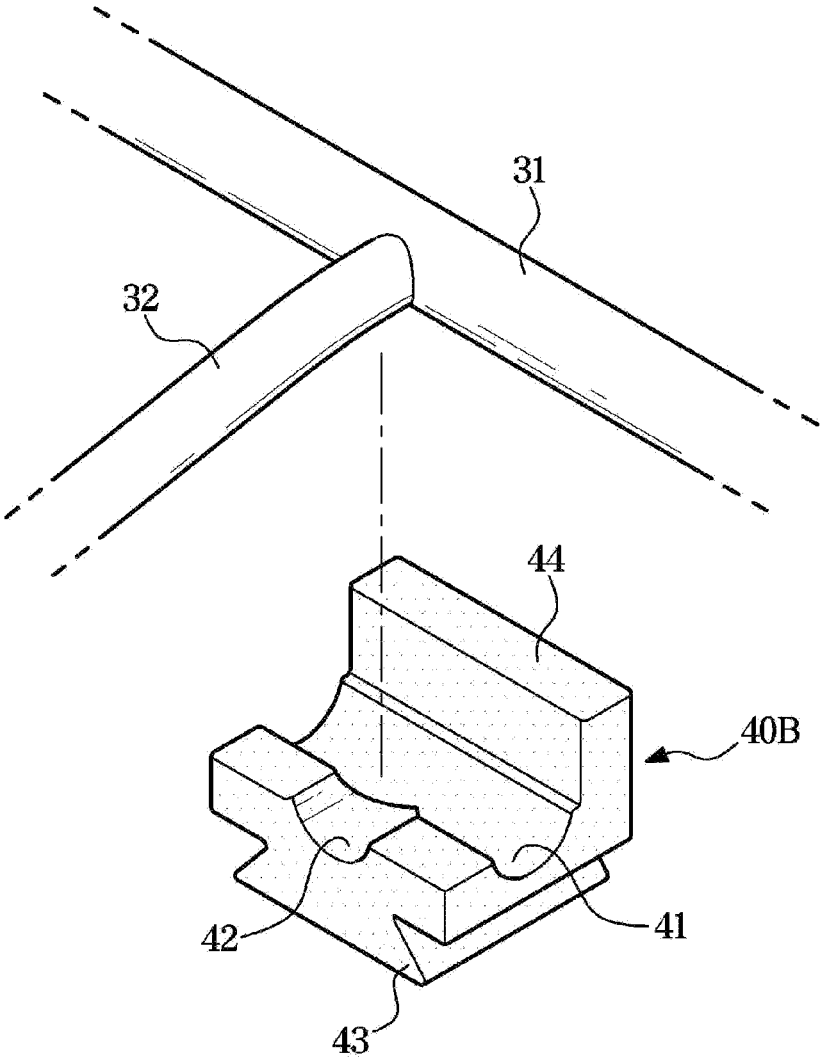
FIG. 7 is a perspective view of a T-shaped buffer member provided in the refrigerator according to an embodiment of the present disclosure.
Figure 8:
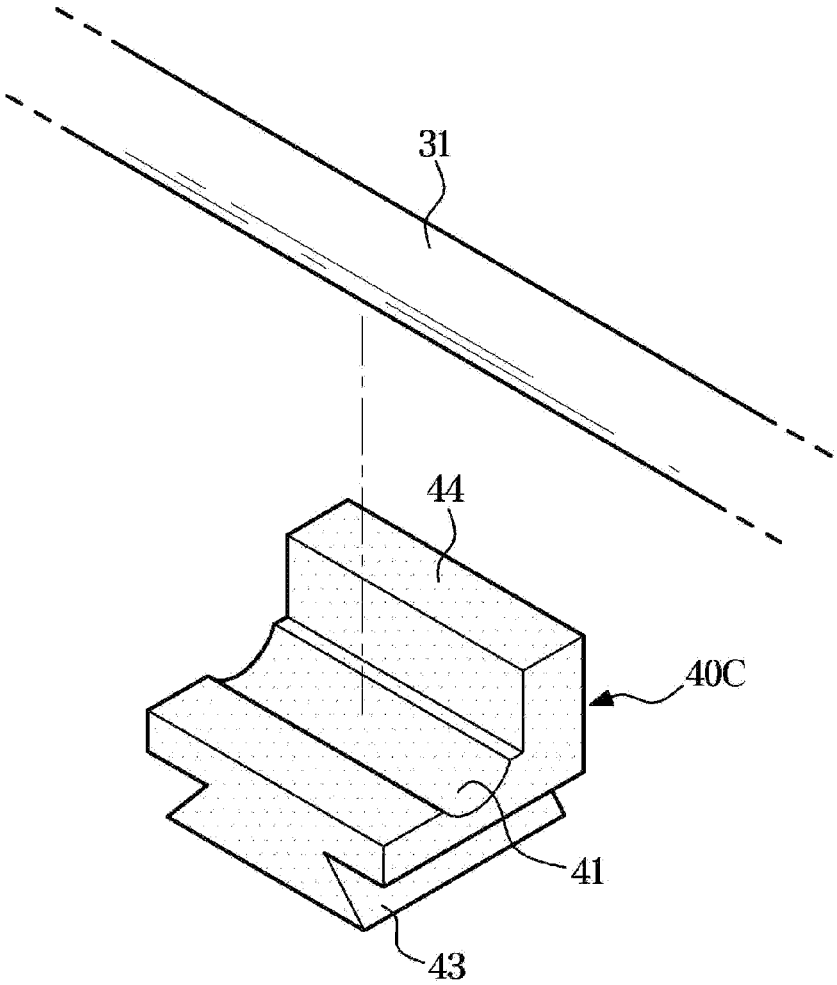
FIG. 8 is a perspective view of a straight buffer member provided in the refrigerator according to an embodiment of the present disclosure.

As illustrated in FIGS. 6 to 8, each of the buffer members 40A, 40B, and 40C includes a first seating groove 41 provided on an upper surface thereof and extending in the front-rear direction so that a predetermined portion of the rack frame 31 is seated thereon, and a second seating groove 42 provided on the upper surface thereof and extending in the left-right direction so that a predetermined portion of the support 32 connected to the rack frame 31 is seated thereon.

The first seating groove 41 and the second seating groove 42 have an arc-shaped cross section to correspond to lower portions of the rack frame 31 and the support 32. Because the rack frame 31 has a larger diameter than the support 32, the first seating groove 41 has a larger radius of curvature than the second seating groove 42.

Each of the buffer member 40A, 40B, and 40C further includes a locking part 43 protruding from a lower surface thereof to be inserted into the support protrusion 12, and the support protrusion 12 includes a locking groove 12*a* through which the locking part 43 is inserted. The locking part 43 and the locking groove 12*a* have a trapezoidal cross section and extend in the left-right direction. One side of the locking groove 12*a* is open toward the inside of the storage compartment 10*a*.

Therefore, the locking part 43 of the buffer members 40A, 40B, and 40C may be mounted by being inserted into the locking groove 12*a* of the support protrusion 12 while the buffer members 40A, 40B, and 40C are moved in the left-right direction.

Each buffer member 40A, 40B, and 40C includes a side portion 44 protruding upward from one side of the upper surface thereof to face a side surface of the rack frame 31, and the main body 10 includes accommodating grooves 12*b* provided on the opposite inner sidewalls of the storage compartment 10*a* to accommodate the side portions 44 of the buffer members 40A, 40B, and 40C. Therefore, in a process of inserting the locking parts 43 of the buffer members 40A, 40B, and 40C into the locking grooves 12*a* of the support protrusion 12, the side portions 44 of the buffer members 40A, 40B, 40C are accommodated in the accommodating grooves 12*b* of the sidewalls, and thus the buffer members 40A, 40B, and 40C are installed on the support protrusion 12.

Although not clearly shown in the drawings, the side portions 44 of the buffer members 40A, 40B, and 40C are formed to have a width slightly larger than a depth of the accommodating grooves 12*b*. This is to allow a portion of the side portion 44 to slightly protrude outside the accommodating groove 12*b* even in a state in which the side portion 44 is accommodated in the accommodating groove 12*b*. Accordingly, the side surface of the rack frame 31 is maintained in a state of being spaced apart from an inner sidewall 11 of the storage compartment 10*a* by the side portions 44 of the buffer members 40A, 40B, and 40C.

As illustrated in FIG. 6, the buffer members 40A, 40B, and 40C include the L-shaped buffer member 40A in which the first and second seating grooves 41 and 42 are connected in an L shape. The L-shaped buffer member 40A is formed such that the second seating groove 42 is connected to a front end or a rear end of the first seating groove 41.

In the present embodiment, the L-shaped buffer member 40A is provided such that the first seating groove 41 supports a rear edge of the rack 30, that is, a predetermined portion of a rear end of the rack frame 31, and the second seating groove 42 supports the predetermined portion of the support 32 located at the rearmost side which is connected to the rack frame 31.

The L-shaped buffer member 40A also includes a rear portion 45 protruding upward from a rear side of the upper surface thereof to face the rear end of the rack frame 31. The rear portion 45 prevents the rack 30 from being inserted into the storage compartment 10*a* by a predetermined depth or more.

The present embodiment illustrates that the L-shaped buffer member 40A is applied to the rear edge of the rack 30, but the L-shaped buffer member 40A may be applied to a front edge of the rack 30.

As illustrated in FIG. 7, the buffer members 40A, 40B, and 40C include the T-shaped buffer member 40B in which the first and second seating grooves 41 and 42 are connected in a T shape by connecting the second seating groove 42 to an intermediate portion of the first seating groove 41.

The T-shaped buffer member 40B is provided such that the first seating groove 41 supports a predetermined front portion and a predetermined rear portion with respect to a region of the rack frame 31 to which the support 32 is connected, and the second seating groove 42 supports a predetermined portion of one end of the support 32 connected to the rack frame 31.

As illustrated in FIG. 8, the buffer members 40A, 40B, and 40C also include the straight buffer member 40C that supports only the rack frame 31 by including only the first seating groove 41.

The straight buffer member 40C is provided such that the first seating groove 41 supports a portion of the rack frame 31 to which the support 32 is not connected.

Therefore, when the buffer members 40A, 40B, and 40C as above are installed on the support protrusion 12 so that the rack frame 31 is spaced apart from the upper surface of the support protrusion 12 and the inner sidewall 11 of the storage compartment, vibration generated during the operation of the refrigerator is not transmitted or very weakly to the rack 30, so that a state in which wine bottles are placed on the rack 30 may be maintained more stably.

The present disclosure illustrates that the rack 30 is provided such that wine bottles are placed thereon, but is not limited thereto. That is, a rack used for storing other storage items other than wine bottles may also be supported by the buffer members 40A, 40B, and 40C.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

The invention claimed is:

1. A refrigerator comprising:

a main body in which a storage compartment is provided;

a rack disposed inside the storage compartment;

a pair of support protrusions, one of the support protrusions protruding from a corresponding one of opposite inner sidewalls of the storage compartment to support the rack; and a buffer member disposed on an upper portion of the one of the support protrusions to elastically support a lower portion of the rack, wherein the one of the support protrusions comprises a locking groove extending from the corresponding one of the opposite inner sidewalls toward the storage compartment, wherein the buffer member comprises a locking part protruding from a lower surface of the buffer member to be inserted into the locking groove in a direction parallel to an extending direction of the locking groove, and wherein the rack comprises a pair of rack frames extending in a front-rear direction to be placed on the pair of support protrusions, and a plurality of supports extending in a left-right direction to be fixed to the pair of rack frames and spaced apart from each other in the front-rear direction.

2. The refrigerator according to claim 1, wherein the buffer member comprises a first seating groove extending in the front-rear direction so that one of the pair of rack frames is seated thereon.

3. The refrigerator according to claim 2, wherein the buffer member comprises a straight buffer member comprising only the first seating groove.

4. The refrigerator according to claim 2, wherein the buffer member comprises a second seating groove in which one of the plurality of supports is seated.

5. The refrigerator according to claim 4, wherein the buffer member comprises an L-shaped buffer member in which the first seating groove and the second seating groove are connected to form an L shape.

6. The refrigerator according to claim 5, wherein the L-shaped buffer member further comprises a rear portion protruding upward from a rear side of an upper surface of the L-shaped buffer member to face a rear end of the one of the pair of the rack frames.

7. The refrigerator according to claim 4, wherein the buffer member comprises a T-shaped buffer member in which the first seating groove and the second seating groove are connected to form a T shape.

8. The refrigerator according to claim 1, wherein the locking part and the locking groove have a trapezoidal cross section and extend in a left-right direction.

9. The refrigerator according to claim 1, wherein:

the buffer member comprises a side portion protruding upward from one side of an upper surface of the buffer member to face a side surface of one of the pair of rack frames, and the main body comprises an accommodating groove provided on the corresponding one of the opposite inner sidewalls to accommodate the side portion.

10. The refrigerator according to claim 9, wherein the side portion has a larger width than a depth of the accommodating groove.

* * * * *